US007331112B2

(12) United States Patent
Gibbs

(10) Patent No.: US 7,331,112 B2
(45) Date of Patent: Feb. 19, 2008

(54) THIRD-AXIS LEVELING BLOCK FOR A BOW SIGHT

(76) Inventor: Charles Stephen Gibbs, 1364 N. County Rd., 700 West, Holton, IN (US) 47023

( * ) Notice: Subject to any disclaimer, the term of this patent is extended or adjusted under 35 U.S.C. 154(b) by 0 days.

(21) Appl. No.: 11/605,036

(22) Filed: Nov. 28, 2006

(65) Prior Publication Data

US 2007/0163131 A1 Jul. 19, 2007

Related U.S. Application Data

(60) Provisional application No. 60/740,771, filed on Nov. 29, 2005.

(51) Int. Cl.
*F41G 1/467* (2006.01)

(52) U.S. Cl. ..... 33/265

(58) Field of Classification Search ..... 33/265; 124/87

See application file for complete search history.

(56) References Cited

U.S. PATENT DOCUMENTS

| | | | | |
|---|---|---|---|---|
| 3,574,944 A | | 4/1971 | Reynolds | |
| 3,715,807 A | * | 2/1973 | Heffer | 33/265 |
| 3,822,479 A | | 7/1974 | Kowalski | |
| 4,020,560 A | | 5/1977 | Heck | |
| 4,535,747 A | | 8/1985 | Kudlacek | |
| 4,543,728 A | | 10/1985 | Kowalski | |
| 4,584,777 A | | 4/1986 | Saunders | |
| 4,616,422 A | * | 10/1986 | Gaddy | 33/265 |
| 4,757,614 A | | 7/1988 | Kudlacek | |
| 4,761,888 A | | 8/1988 | Kudlacek | |
| 5,174,269 A | | 12/1992 | Sappington | |
| 5,524,601 A | | 6/1996 | Slates et al. | |
| 5,720,270 A | * | 2/1998 | Meicke | 124/87 |
| RE36,266 E | | 8/1999 | Gibbs | |
| 6,609,306 B2 | * | 8/2003 | Johnson et al. | 33/265 |
| 6,701,632 B2 | * | 3/2004 | Henry | 33/265 |
| 6,802,129 B1 | * | 10/2004 | Wirth | 33/265 |
| 2005/0247296 A1 | * | 11/2005 | Leisner | 124/87 |
| 2006/0201005 A1 | * | 9/2006 | Lueck | 33/265 |

OTHER PUBLICATIONS

CHEK-IT, "S-9000 Tournament Sight," 1998.
CHEK-IT, "SG-1000 Tournament Sight," 1998.

* cited by examiner

*Primary Examiner*—Christopher W Fulton
(74) *Attorney, Agent, or Firm*—Leydig, Voit & Mayer, Ltd

(57) ABSTRACT

The present invention provides a "third-axis" leveling block for use with an archery sight. The third-axis leveling block holds an archery sighting device (e.g., a scope or a pin sight) as know in the art. The leveling block adjusts the position of the sight in two axes by means of cams. One of the cams adjusts the sighting device to the archer's preferred cant. The other cam adjusts the angle of the sighting device with respect to the bow to keep the archer's cant consistent when the bow is raised or lowered for shooting at targets at any elevation, above, below, or on the same level as the archer.

24 Claims, 7 Drawing Sheets

THIRD-AXIS LEVELING BLOCK FOR A BOW SIGHT

CROSS-REFERENCE TO RELATED APPLICATION

This application claims priority to U.S. Provisional Patent Application No. 60/740,771, "A Third-Axis Leveling Block for a Bow Sight," which was filed on Nov. 29, 2005, and which is incorporated herein by reference in its entirety.

FIELD OF THE INVENTION

The present invention relates generally to sights for archery bows and, more particularly, to devices for leveling sights for archery bows.

BACKGROUND OF THE INVENTION

Archery sights have long been available for use when the bow is held vertically and when the archer and the target are on the same level. As an example of a modern archery sight, please see U.S. Pat. RE 36,266 ("Bow Sight").

However, these conditions are not always met in the field. First, while archers have long been told to hold their bows in a vertical plane, this orientation is not entirely natural to the human arm. Holding the bow in this vertical position places some rotational stress on the arm. "Canting" the bow, that is, holding it at a slight angle from the vertical plane, feels more natural and reduces the stresses acting on the archer and on the bow thus leading to more accurate shots.

Second, and relatedly, archers in some situations tend to change the cant at which they hold their bow. This change is noticeable when the archer and the target are not on the same level. While hunting in rough terrain, for example, the archer's best (or only) shot often presents itself when the target is either above or below the archer's level. When moving the bow to aim at a target above or below the archer's own position, the archer tends to change the cant of the bow. When using a traditional archery sight, this unconscious change in cant results in shots hitting to the right or left of the target.

For these and other reasons, there is a need for an archery sight that compensates for conditions beyond the idealized conditions of the archery range.

BRIEF SUMMARY OF THE INVENTION

In view of the foregoing, the present invention provides a "third-axis" leveling block for use with an archery sight. The third-axis leveling block holds an archery sighting device (e.g., a scope or a pin sight) as know in the art. The leveling block adjusts the position of the sight in two axes by means of cams. By moving the cams, the archer adjusts the sight to the archer's natural cant and helps the archer to maintain a consistent cant when shooting at targets at any elevation, above, below, or on the same level as the archer.

In some embodiments, the leveling block attaches to an elevation block (possibly by a dovetail connector) of a traditional bow-sight structure. The leveling block in turn holds a traditional sighting device. The leveling block includes two cams to allow adjustments on two generally perpendicular axes. One of the cams adjusts the sighting device to the archer's preferred cant. The other cam adjusts the angle of the sighting device with respect to the bow to keep the archer's cant consistent when the bow is raised or lowered.

In some embodiments, part of the leveling block is made of one piece with the elevation block. In some embodiments, an additional cam (or two additional cams) is (are) added on an axis (axes) parallel to one (both) of the first two cams to allow linear adjustments of the sight.

BRIEF DESCRIPTION OF THE SEVERAL VIEWS OF THE DRAWINGS

While the appended claims set forth the features of the present invention with particularity, the invention, together with its objects and advantages, may be best understood from the following detailed description taken in conjunction with the accompanying drawings of which:

DETAILED DESCRIPTION OF THE INVENTION

Figure 1:
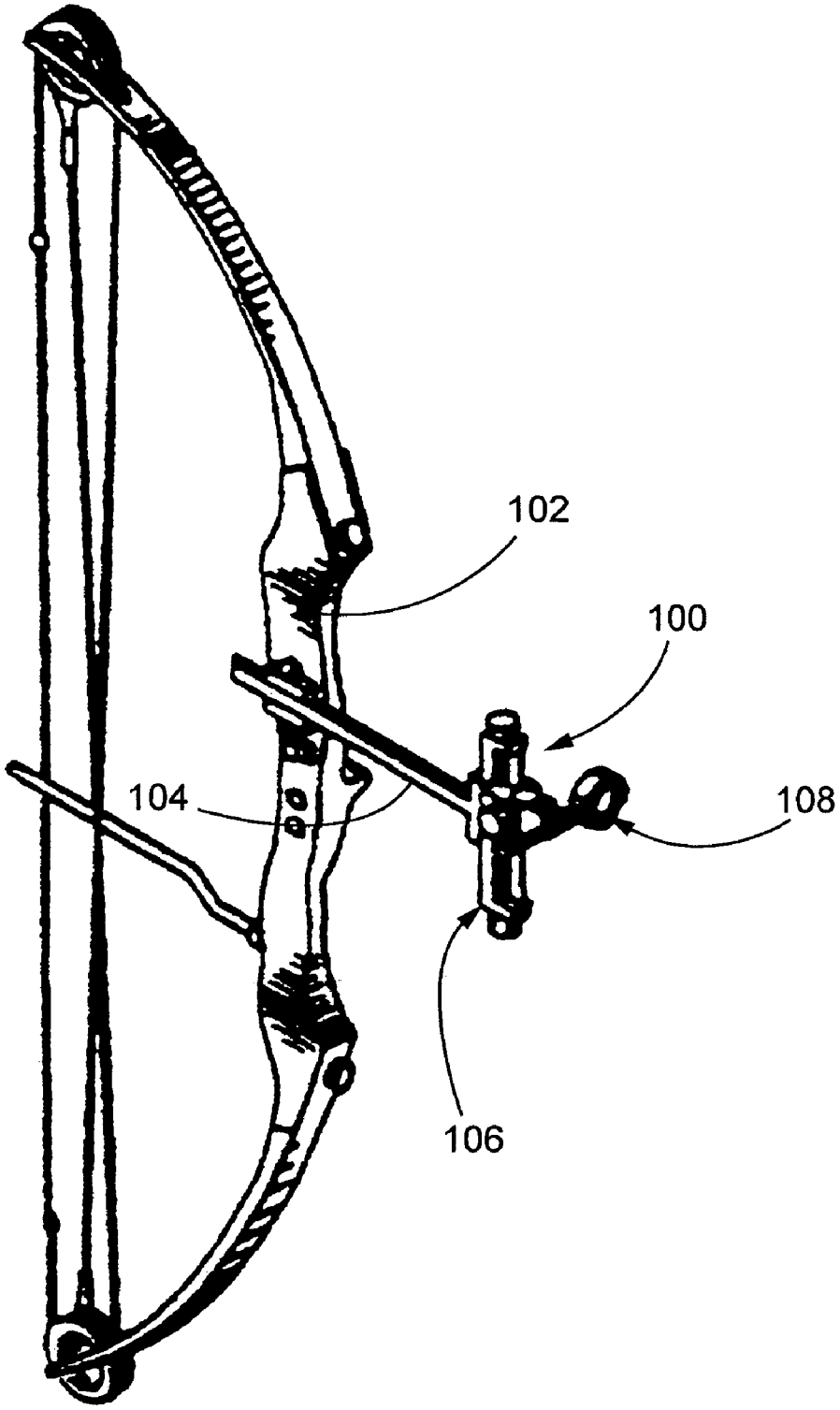
FIG. 1 is a perspective view of a typical archery bow equipped with a bow sight.

Turning to the drawings, wherein like reference numerals refer to like elements, the present invention is illustrated as being implemented in a suitable environment. The following description is based on embodiments of the invention and should not be taken as limiting the invention with regard to alternative embodiments that are not explicitly described herein.

A third-axis leveling block according to the present invention can be incorporated into the archery bow arrangement 100 shown in FIG. 1. Releasably attached to an archery bow 102 and extending outwardly from the archery bow 102 in the general direction of a target, is an elongated support bar 104. Attached to the end of the elongated support bar 104 is a sighting frame 106 which often takes the form of a vertical C-shaped yoke. The sighting frame 106 can support various adjustment mechanisms, including the third-axis leveling block of the present invention (see FIGS. 2*a* and 2*b*), that vary the spatial relationship between the archery bow 102 and the bow-sighting device 108. Generally, an archer uses these adjustment mechanisms to compensate for various conditions, such as a distance from the archer to the target, wind, elevation of the target relative to the archer, and the archer's natural cant of the bow. For details of a possible archery bow arrangement 100, please see U.S. Pat. RE 36,266 ("Bow Sight"), which is incorporated herein by reference in its entirety. While the archery bow arrangement 100 shown in FIG. 1 is quite sophisticated, other arrangements are known in the art, and the present invention is not limited to any specific structural context.

Figure 2A:
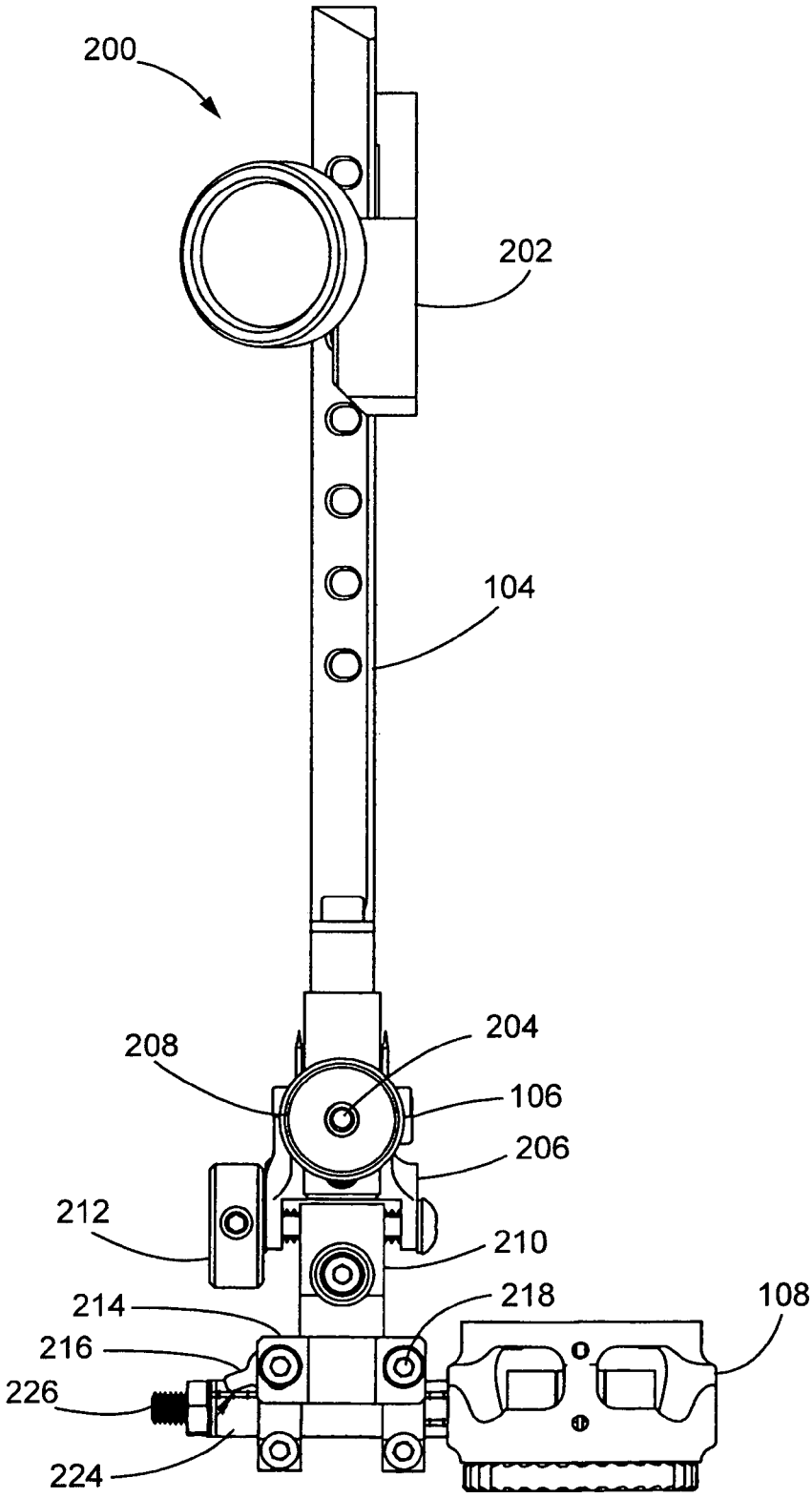
FIGS. 2*a* and 2*b* are perspective views of a bow sight incorporating a third-axis leveling block according to the present invention.
Figure 2B:
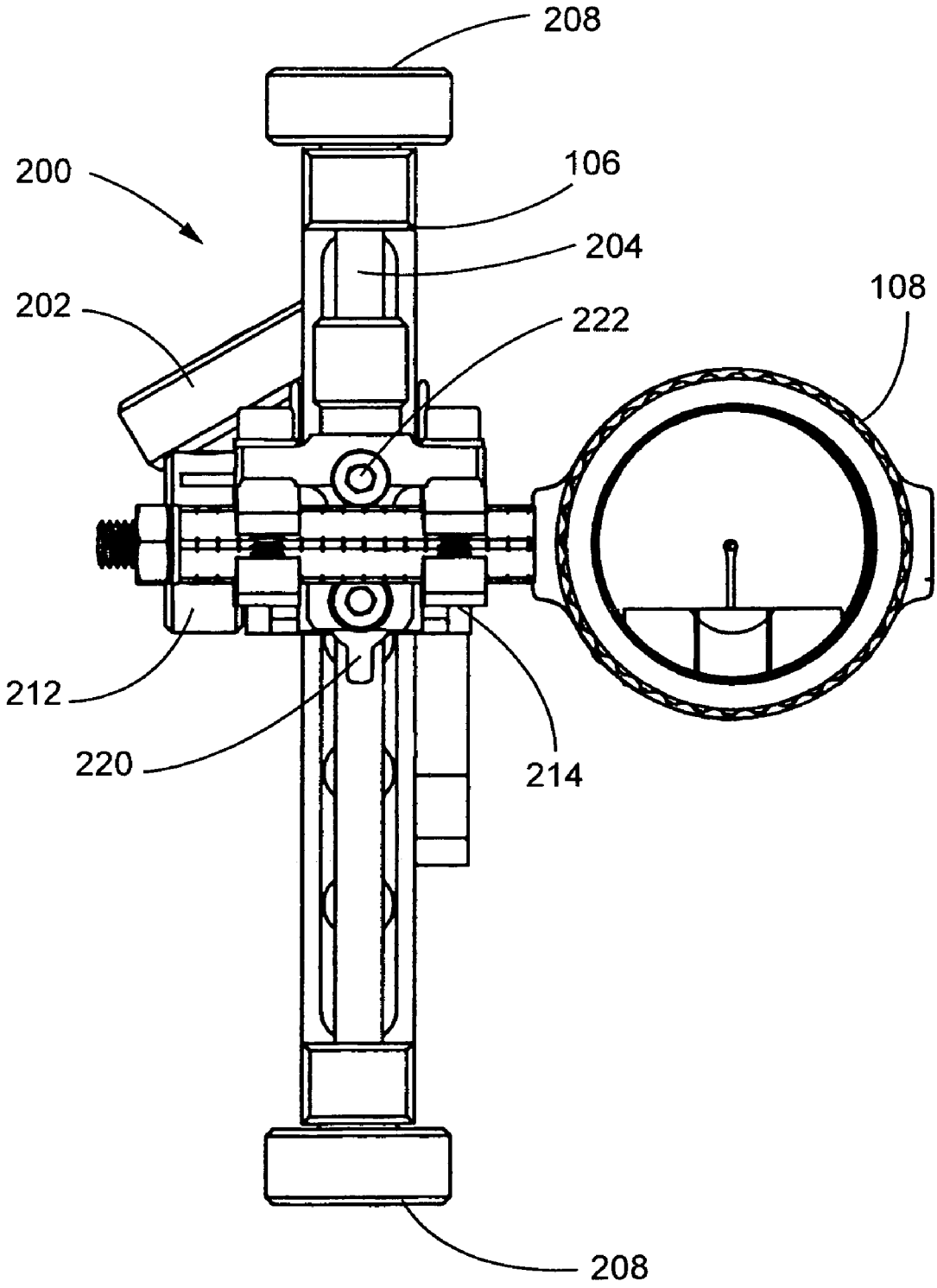

FIGS. 2*a* and 2*b* are different views of a complete archery sight mechanism 200 that incorporates a third-axis leveling block according to the present invention. An attachment mechanism 202 releasably attaches the elongated support bar 104 to the archery bow 102. (For clarity's sake, the archery bow 102 itself is not shown in these figures.) In the archery sight mechanism 200 shown in FIGS. 2*a* and 2*b*, the sighting frame 106 attached to the end of the elongated support bar 104 holds a rotatable lead screw 204. The lead screw 204 holds an elevation block 206 (more easily seen in FIG. 2*b*). When either elevation adjustment knob 208, located at either end of the lead screw 204, is turned, the elevation block 206 is raised or lowered to adjust for a distance from the archer to a target. U.S. Pat. RE 36,266 presents the details of one possible elevation block arrangement.

In some embodiments, the elevation block 206 supports a windage block 210 (FIGS. 2*b*) on a rotatable lead screw (not shown). When the windage adjustment knob 212 is turned, the rotatable lead screw turns, and the windage block 210 moves horizontally, perpendicular to the possible movement of the elevation block 206. The archer uses the windage block 210 to adjust for prevailing wind conditions. U.S. Pat. RE 36,266 presents the details of one possible windage block arrangement.

In the arrangement of FIGS. 2*a* and 2*b*, the windage block 210 supports a third-axis leveling block 214 according to the present invention. In one embodiment, the third-axis leveling block 214 includes two adjustment cams and, for each adjustment cam, a pivot. FIG. 2*a* shows a first adjust cam 216 and its pivot 218, while FIG. 2*b* shows a second adjustment cam 220 and its pivot 222. The structure of a possible embodiment of the third-axis leveling block 214 and its attachment mechanisms are shown in greater detail in FIGS. 3, 4*a*, 4*b*, and 4*c*.

The third-axis leveling block 214 of FIGS. 2*a* and 2*b* clamps a tube 224 (FIG. 2*a*) that holds a rod 226 of a bow-sighting device 108. Preferably, the tube 224 has a hexagonal outer cross section to prevent it from rotating within the clamps of the third-axis leveling block 214.

Figure 3:
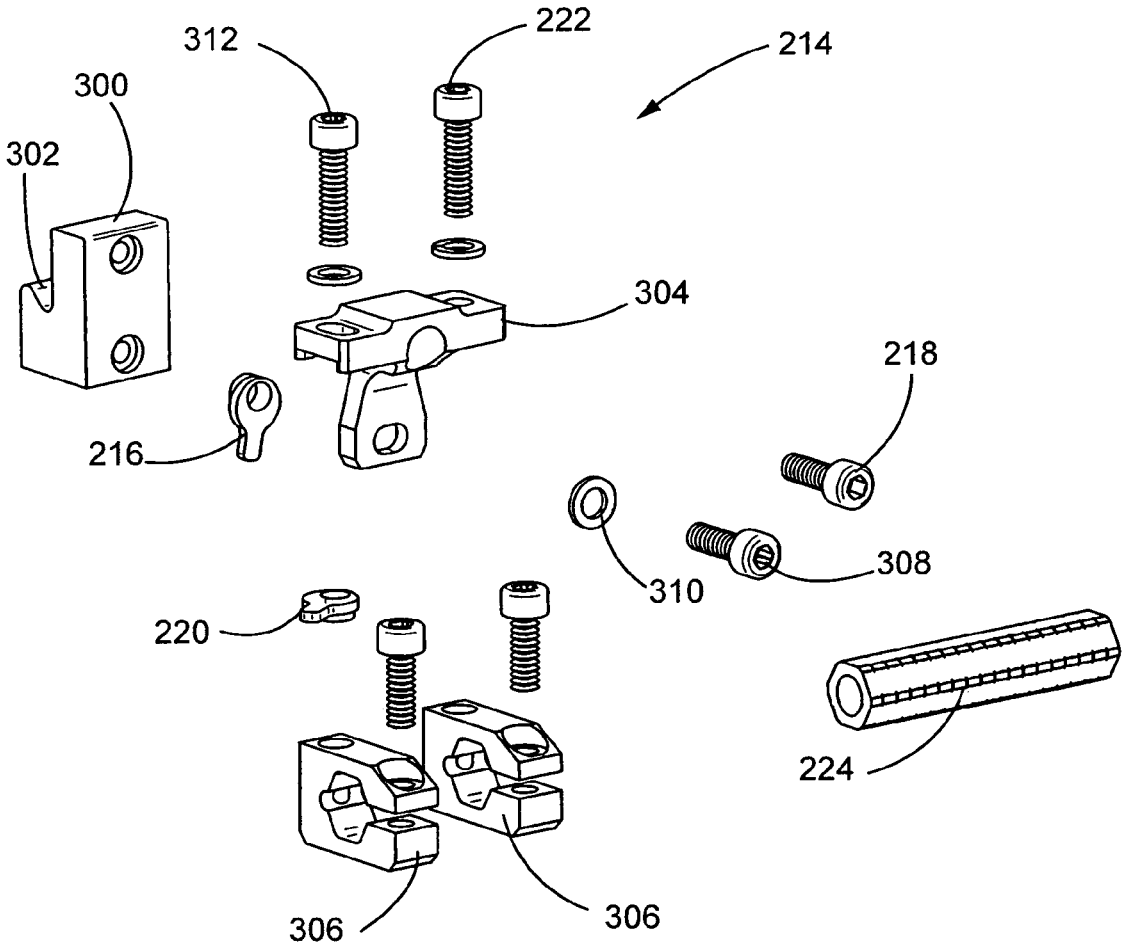
FIG. 3 is an exploded assembly view of a third-axis leveling block.

FIG. 3 shows an exploded assembly of an embodiment of the third-axis leveling block 214. In some embodiments, a mounting block 300 of the third-axis leveling block 214 includes a V-shaped notch 302. This notch 302 forms a half-dovetail connector that attaches to a complementary half-dovetail connector in the windage block 210 (see FIG. 2*b*). The two half-dovetail connectors are wedged tightly together when a screw (not shown) is tightened. This type of connector, described in U.S. Pat. RE 36,266, is preferred because it allows the mounting block 300 of the third-axis leveling block 214 to be tightly and precisely clamped to the windage block 210 via a single screw without putting excessive strain on that screw. In other embodiments, the mounting block 300 of the third-axis leveling block 214 is formed in one piece with the windage block 210. In that case, a dovetail connector is preferred to connect the third-axis leveling block 214/windage block 210 to the elevation block 206.

Attached to the mounting block 300 is a top-hat block 304. (A possible mechanism for connecting these two pieces is discussed below.) A clamp assembly 306, shown in FIG. 3 as consisting of two clamps, is in turn attached to the top-hat block 304. (The present invention is not limited to the details of the specific clamp assembly 306 as shown in FIG. 3.) The clamp assembly 306 clamps the tube 224 (discussed above with reference to FIG. 2*a*) which in its turn holds a rod of a bow-sighting device 108 (not shown in FIG. 3).

The top-hat block 304 is mounted in such a manner that it can pivot relative to the mounting block 300. The first pivot 218 is shown in FIG. 3 as a screw that passes through a hole in the top-hat block 304 and screws into a first threaded hole in the mounting block 300. In some embodiments, the first pivot 218 includes a friction-reducing element (such as a Teflon washer). A second screw 308 passes through an elongated hole in the top-hat block 304, passes through a hole in the first cam 216, and screws into a second threaded hole in the mounting block 300. Again, a friction-reducing element 310 can be used. The first cam 216 includes a circular boss (shown in FIGS. 4*a*, 4*b*, and 4*c*) that fits into a countersunk portion of the second hole in the mounting block 300. When the first cam 216 is rotated about that boss as it sits in the countersunk portion of the second hole in the mounting block 300, the first cam 216 pushes on a countersunk area on the top-hat block 304 which causes the top-hat block 304 to pivot around the first pivot screw 218. The elongated hole in the top-hat block 304 allows the top-hat block 304 to move relative to the second screw 308 and also limits the amount of such movement.

In some embodiments, the clamp assembly 306 is pivotably mounted to the top-hat block 304 in a manner similar to the mounting of the top-hat block 304 to the mounting block 300. In the embodiment of FIG. 3, the second pivot 222 is a screw that passes through a hole in the top-hat block 304 and screws into a first threaded hole in the clamp assembly 306. A second screw 312 passes through an elongated hole in the top-hat block 304, passes through a hole in the second cam 220, and screws into a second threaded hole in the clamp assembly 306. The second cam 220 includes a circular boss (shown in FIGS. 4*a*, 4*b*, and 4*c*) that fits into a countersunk portion of the second hole in the clamp assembly 306. When the second cam 220 is rotated about that boss as it sits in the countersunk portion of the second hole in the clamp assembly 306, the second cam 220 pushes on a countersunk area on the top-hat block 304 which causes the clamp assembly 306 to pivot around the second pivot screw 222. The elongated hole in the top-hat block 304 allows the clamp assembly 306 to move relative to the screw 312 and also limits the amount of such movement.

In a preferred embodiment, the axes of the pivot screws 218 and 222 are perpendicular to one another. This allows the bow-sighting device 108 (shown in FIGS. 2*a* and 2*b*) to be pivoted independently on two axes with respect to the mounting block 300.

In an embodiment not shown in FIG. 3, two additional cams are added that pivot around the screws 218 and 222. This arrangement allows the top-hat block 304 to be linearly shifted with respect to the mounting block 300 by simultaneously shifting two parallel cams, the cam 216 around the screw 308 and the new cam around the screw 218. In this arrangement, if one of a pair of parallel cams is held in place, then the other cam in the pair serves to pivot the top-hat block 304 as described above in the two-cam embodiment. Similarly, the cams 220 around the screw 312 and the new cam around the screw 222 allow the clamp assembly 306 to be moved linearly with respect to the top-hat block 304.

Figure 4A:
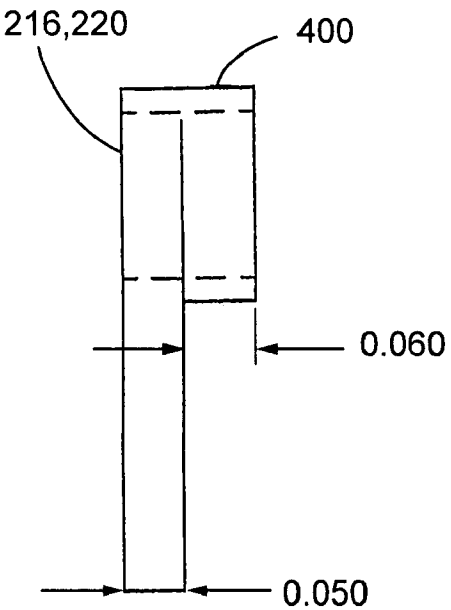
FIGS. 4*a*, 4*b*, and 4*c* are views of a cam usable with a third-axis leveling block.
Figure 4B:
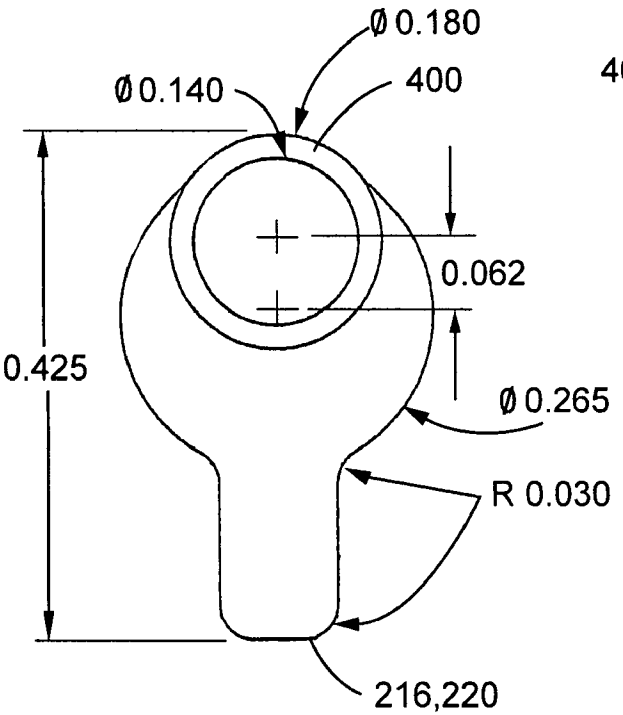
Figure 4C:
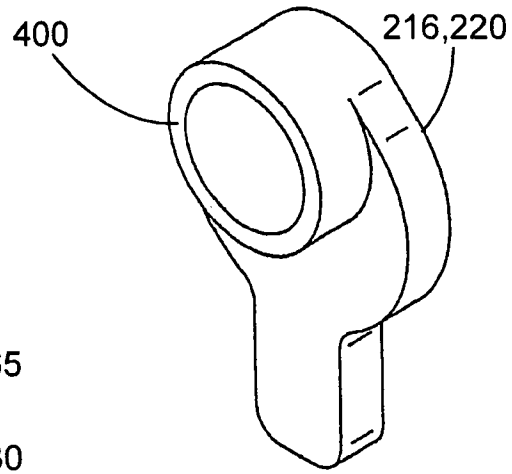

FIGS. 4*a*, 4*b*, and 4*c* are different views of a cam 216, 220 that can be used with the third-axis leveling block 214. The circular boss 400 that fits into the countersunk portions of the holes in the mounting block 300 and in the clamp assembly 306 is clearly shown in all three figures. The dimensions are given in inches and are appropriate for one embodiment. Other embodiments may require other dimensions. The diameter of the hole through the cam 216, 220 should be large enough that the cam 216, 220 does not bind on the screw 308, 312 that passes through it. The offset of the hole to the center of the cam surface (0.62 inches in FIG. 4*b*) and the outer diameter of the cam surface (0.265 inches in FIG. 4*b*) determine how much movement is caused when the cam 216, 220 pivots. To ease the manufacture of the third-axis leveling block 214, it is preferred that the two cams 216, 220 are identical.

Figure 5A:
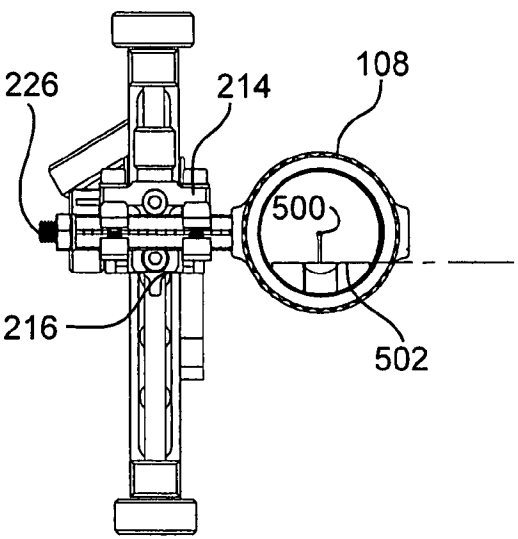
FIGS. 5*a*, 5*b*, and 5*c* are views showing the effects on a bow sight of a first cam adjustment of a third-axis leveling block.
Figure 5B:
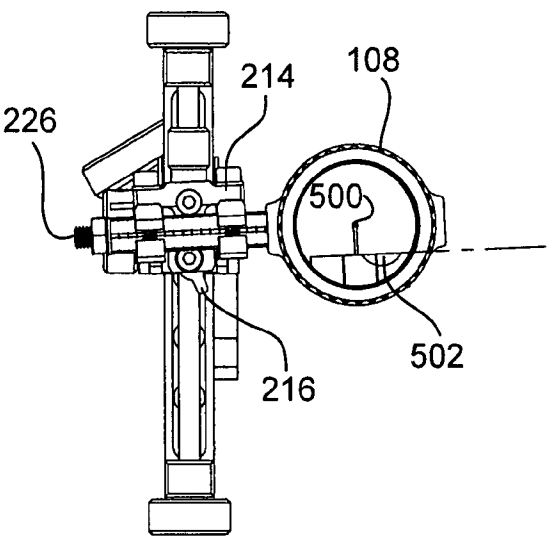
Figure 5C:
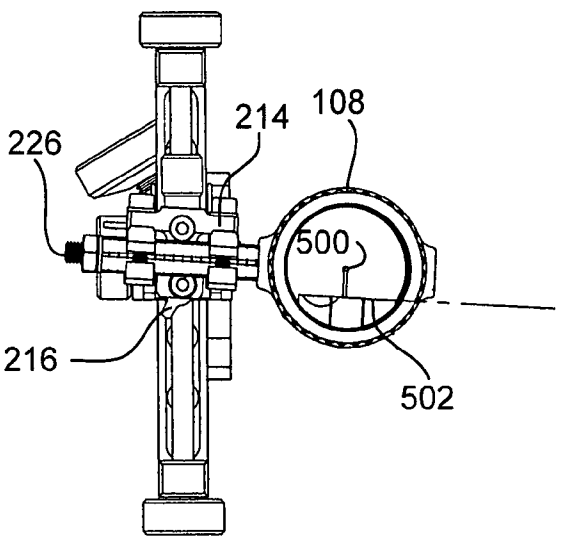

FIGS. 5*a*, 5*b*, and 5*c* show how pivoting the first cam 216 adjusts the position of the bow-sighting device 108. In FIG. 5*a*, the first cam 216 is centered, and the bow-sighting device 108 is held horizontal. In FIG. 5*b*, the first cam 216 is rotated counterclockwise from the center position which lifts the bow-sighting device 108 relative to the archery bow 102 (not shown), while in FIG. 5*c*, the first cam 216 is rotated clockwise from the center position which lowers the bow-sighting device 108. This adjustment allows the archer to keep the rod 226 of the bow-sighting device 108 parallel to the ground and the sighting spot 500 of the bow-sighting device 108 directly above the future flight path of an arrow even though the archery bow 102 is held at a cant. By consulting the level 502, the archer can maintain a consistent cant when pointing the archery bow 102 uphill or downhill.

Figure 6C:
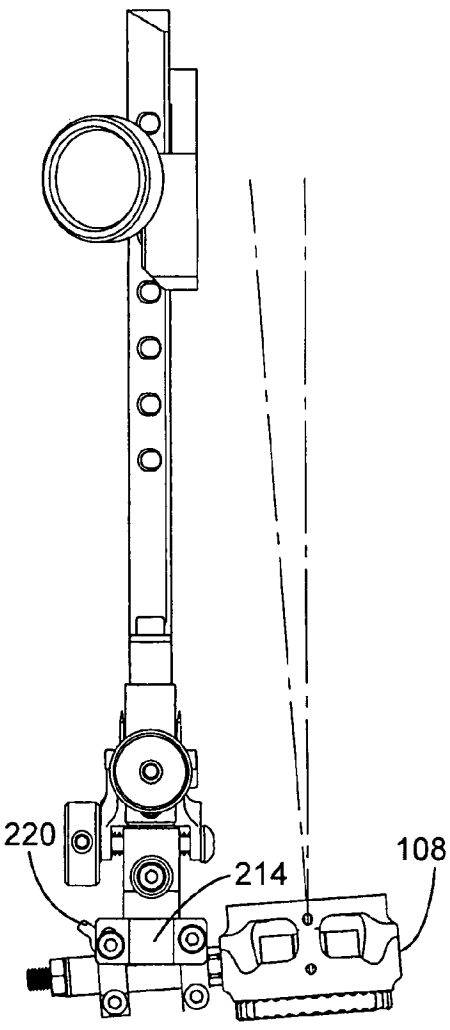
FIGS. 6*a*, 6*b*, and 6*c* are views showing the effects on a bow sight of a second cam adjustment of a third-axis leveling block.
Figure 6B:
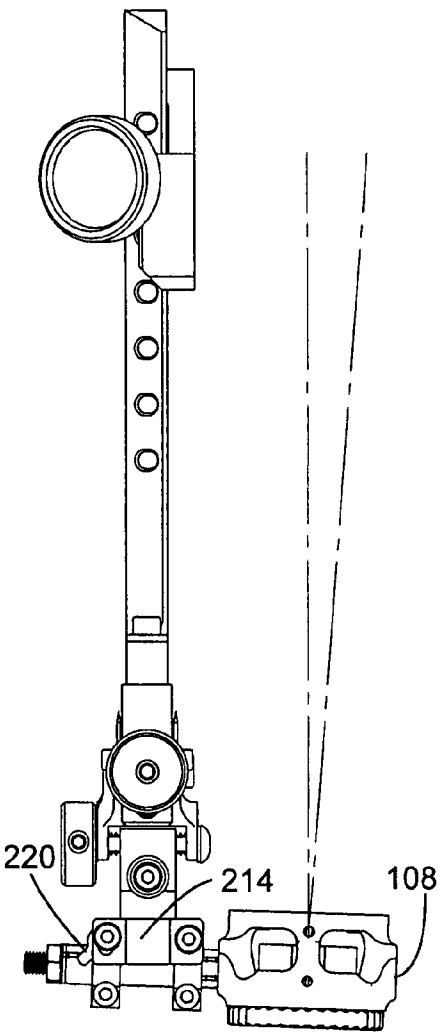
Figure 6A:
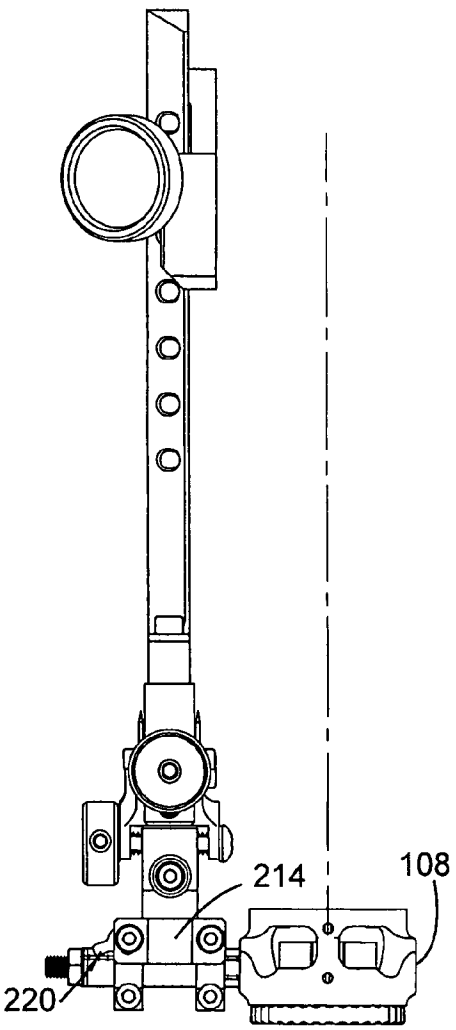

FIGS. 6*a*, 6*b*, and 6*c* show how pivoting the second cam 220 adjusts the position of the bow-sighting device 108. In FIG. 6*a*, the bow-sighting device 108 is at a median distance from the archer. In FIG. 6*b*, the second cam 220 is rotated counterclockwise which pivots the bow-sighting device 108 away from the archer, while in FIG. 6*c*, the second cam 220 is rotated clockwise which pulls the bow-sighting device 108 toward the archer. This adjustment keeps the bow-sighting device 108 aligned with the flight of an arrow even as the bow 102 twists under full draw.

In view of the many possible embodiments to which the principles of the present invention may be applied, it should be recognized that the embodiments described herein with respect to the drawing figures are meant to be illustrative only and should not be taken as limiting the scope of the invention. Those of skill in the art will recognize that some implementation details, such as the attachments to the windage block and to the bow-sighting device, are determined by specific situations. Therefore, the invention as described herein contemplates all such embodiments as may come within the scope of the following claims and equivalents thereof.

We claim:

1. A third-axis leveling block for use with an archery bow, the third-axis leveling block comprising:

a mounting block with first and second holes therein;

a top-hat block with a first round hole and a first elongated hole therein and with a second round hole and a second elongated hole therein;

a first screw passing through the first round hole of the top-hat block and into the first hole of the mounting block;

a first cam with a hole therein;

a second screw passing through the first elongated hole of the top-hat block, through the hole of the first cam, and into the second hole of the mounting block, the first and second screws attaching the top-hat block to the mounting block such that the top-hat block is pivotable about an axis of the first screw and is pivotable by rotation of the first cam about the second screw;

a second cam with a hole therein;

a clamp assembly with first and second holes therein;

a third screw passing through the second round hole of the top-hat block and into the first hole of the clamp assembly;

a fourth screw passing through the second elongated hole of the top-hat block, through the hole of the second cam, and into the second hole of the clamp assembly, the third and fourth screws attaching the clamp assembly to the top-hat block such that the clamp assembly is pivotable about an axis of the third screw and is pivotable by rotation of the second cam about the fourth screw.

2. The third-axis leveling block of claim 1 wherein the mounting block comprises a split block, the split block comprising:

a first half-dovetail connector configured for attaching to a second half-dovetail connector of a windage block.

3. The third-axis leveling block of claim 1 wherein the mounting block is of one piece with a windage block.

4. The third-axis leveling block of claim 1 wherein the first and second holes of the mounting block are threaded to receive threads of the first and second screws.

5. The third-axis leveling block of claim 1 wherein the axis of the first screw is generally perpendicular to the axis of the third screw.

6. The third-axis leveling block of claim 1 wherein the first cam comprises a shoulder around the hole of the first cam, wherein the second hole of the mounting block comprises a countersunk portion, wherein the shoulder of the first cam is received into the countersunk portion of the second hole of the mounting block, and wherein the first cam rotates about an axis defined by the shoulder of the first cam received into the countersunk portion of the second hole of the mounting block.

7. The third-axis leveling block of claim 1 wherein the clamp assembly comprises two clamps.

8. The third-axis leveling block of claim 1 wherein the first and second holes of the clamp assembly are threaded to receive threads of the third and fourth screws.

9. The third-axis leveling block of claim 1 wherein the second cam comprises a shoulder around the hole of the second cam, wherein the second hole of the clamp assembly comprises a countersunk portion, wherein the shoulder of the second cam is received into the countersunk portion of the second hole of the clamp assembly, and wherein the second cam rotates about an axis defined by the shoulder of the second cam received into the countersunk portion of the second hole of the clamp assembly.

10. The third-axis leveling block of claim 1 further comprising:

a tube, the tube clamped by the clamp assembly, the tube configured for holding a rod of a sighting device.

11. The third-axis leveling block of claim 10 wherein the tube has a hexagonal outer cross section.

12. The third-axis leveling block of claim 1 further comprising:

a first friction-reducing wear element disposed between the mounting block and the top-hat block; and a second friction-reducing wear element disposed between the top-hat block and the clamp assembly.

13. A sight for an archery bow, the sight comprising:

an elongated support element attachable to the archery bow and extending outwardly from the archery bow in the general direction of a target;

a generally vertically extending frame attached to the elongated support element;

a generally vertically extending first lead screw rotatably supported by the frame;

an elevation block embracing the first lead screw and movable vertically therealong;

a generally horizontally extending second lead screw rotatably supported by the elevation block;

a windage block embracing the second lead screw and movable transversally therealong relative to the elevation block;

a third-axis leveling block attached to the windage block; and a sighting device attached to the third-axis leveling block.

14. The sight for an archery bow of claim 13 wherein the third-axis leveling block comprises:

a split block attached to the windage block;

a top-hat block pivotably attached to the split block, the top-hat block pivotable by rotation of a first cam; and a clamp assembly pivotably attached to the top-hat block, the clamp assembly pivotable by rotation of a second cam, the clamp assembly attached to the sighting device.

15. The sight for an archery bow of claim 13 wherein the third-axis leveling block comprises:

a top-hat block pivotably attached to the windage block, the top-hat block pivotable by rotation of a first cam; and a clamp assembly pivotably attached to the top-hat block, the clamp assembly pivotable by rotation of a second cam, the clamp assembly attached to the sighting device.

16. A third-axis leveling block for use with an archery bow, the third-axis leveling block attachable to a bow-sight support structure, the third-axis leveling block configured for holding a sighting device, the third-axis leveling block comprising:

a mounting block configured for attaching to the bow-sight support structure;

a top-hat block pivotably attached to the mounting block, the top-hat block pivotable by rotation of a first cam; and a clamp assembly pivotably attached to the top-hat block, the clamp assembly pivotable by rotation of a second cam, the clamp assembly configured for holding the sighting device.

17. The third-axis leveling block of claim 16 wherein the mounting block comprises a split block, and wherein the split block is configured for attaching to a windage block of the bow-sight support structure.

18. The third-axis leveling block of claim 16 wherein the mounting block is of one piece with a windage block.

19. The third-axis leveling block of claim 16 wherein the top-hat block is pivotable about a first axis, wherein the clamp assembly is pivotable about a second axis, and wherein the second axis is generally perpendicular to the first axis.

20. The third-axis leveling block of claim 16 wherein the top-hat block is pivotable by rotation of a third cam, and wherein an axis of the third cam is generally parallel to an axis of the first cam.

21. The third-axis leveling block of claim 16 wherein the clamp assembly comprises two clamps.

22. The third-axis leveling block of claim 16 wherein the clamp assembly is pivotable by rotation of a fourth cam, and wherein an axis of the fourth cam is generally parallel to an axis of the second cam.

23. The third-axis leveling block of claim 16 further comprising:

a tube, the tube clamped by the clamp assembly, the tube configured for holding a rod of the sighting device.

24. The third-axis leveling block of claim 16 further comprising:

a first friction-reducing wear element disposed between the mounting block and the top-hat block; and a second friction-reducing wear element disposed between the top-hat block and the clamp assembly.

* * * * *